US006139353A

United States Patent [19]

Muz

[11] Patent Number: 6,139,353

[45] Date of Patent: Oct. 31, 2000

[54] ELECTRICAL CONNECTION ARRANGEMENT MEDICAL USE

[75] Inventor: Edwin Muz, Reutlingen, Germany

[73] Assignee: Nicolay Verwaltungs-GmbH, Nagold, Germany

[21] Appl. No.: 09/285,470

[22] Filed: Apr. 2, 1999

[30] Foreign Application Priority Data

Apr. 11, 1998 [DE] Germany ..... 198 16 247

[51] Int. Cl.[7] ..... H01R 4/24

[52] U.S. Cl. ..... 439/417; 439/736

[58] Field of Search ..... 439/417, 736, 439/835, 406

[56] References Cited

U.S. PATENT DOCUMENTS

| | | | |
|---|---|---|---|
| 4,872,849 | 10/1989 | Long | 439/417 |
| 5,009,618 | 4/1991 | Black et al. | 439/736 |
| 5,622,517 | 4/1997 | Heng et al. | 439/417 |
| 5,641,302 | 6/1997 | Adams | 439/417 |

FOREIGN PATENT DOCUMENTS

| | | |
|---|---|---|
| 0531677A1 | 3/1993 | European Pat. Off. . |
| 9212342 U | 3/1993 | Germany . |
| 9212343 | 3/1993 | Germany . |
| 4403278 | 8/1995 | Germany . |
| 19521176C1 | 12/1996 | Germany . |
| 19708663C1 | 12/1997 | Germany . |

*Primary Examiner*—Paula Bradley
*Assistant Examiner*—Briggitte R Hammond
*Attorney, Agent, or Firm*—Roylance,Abrams,Berdo & Goodman, L.L.P.

[57] ABSTRACT

An electrical connection arrangement has a cutting and clamping contact element including a slot opening for forming the contact with the conductor of an insulated cable. The slot opening has two facing cutting edges and an enlargement serving as the opening for the initial insertion of the end part of the insulated cable. The cutting and clamping contact element is held in the interior of an insulated body. An operating member of insulating material is movably mounted on the insulated body. When a cable is inserted into the enlargement of the cutting and clamping contact element, the cable can be moved by proactive movement of the operating member to form the contact in the zone of the slot opening of the contact element between the cutting edges.

6 Claims, 2 Drawing Sheets

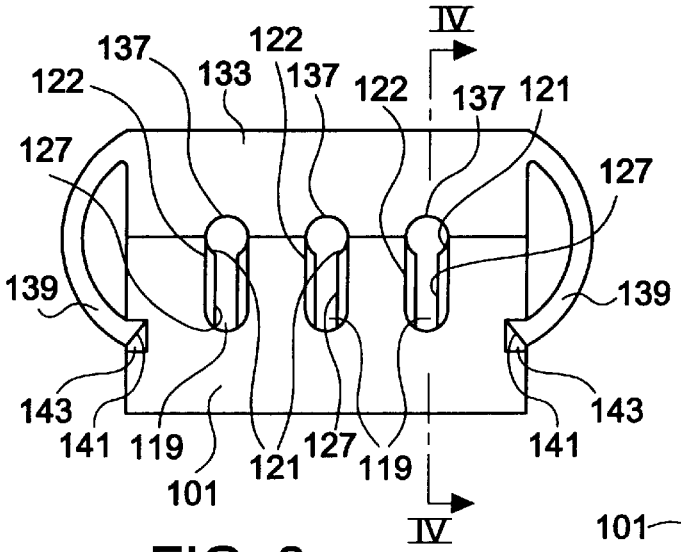
FIG. 3
FIG. 4
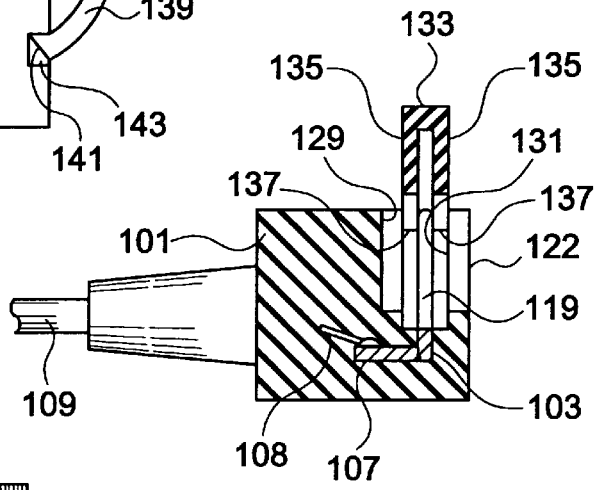
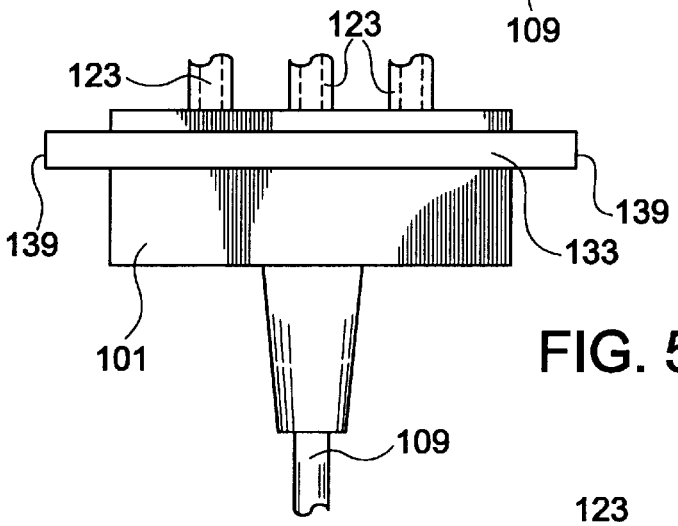
FIG. 5
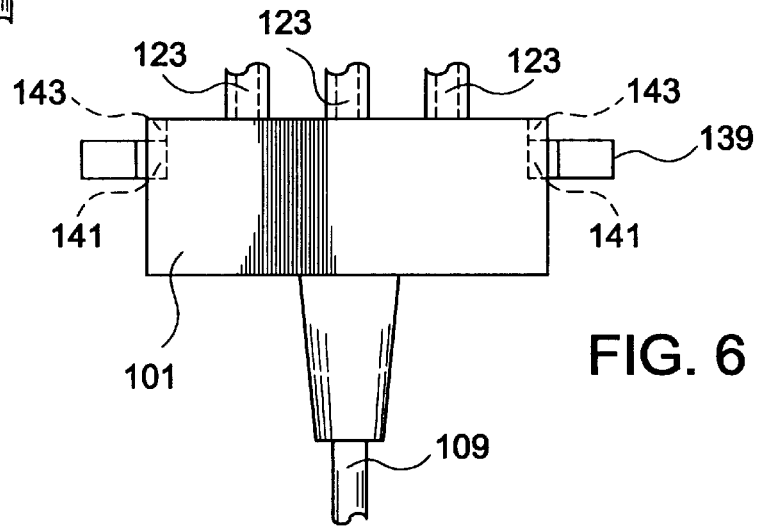
FIG. 6

ELECTRICAL CONNECTION ARRANGEMENT MEDICAL USE

FIELD OF THE INVENTION

The present invention relates to an electrical connection arrangement, especially for use in medical technology. A cutting and clamping contact includes a slot opening for forming the contact with the conductor of an insulated cable. The element has two cutting edges arranged opposite and facing one another, and have an enlargement which serves as the opening for insertion of the end portion of the insulated cable.

BACKGROUND OF THE INVENTION

A connection arrangement having a cutting and clamp element is disclosed in DE 44 03 278 C2.

SUMMARY OF THE INVENTION

Objects of the present invention are to provide a connection arrangement with a cutting and clamping element having its total overall parameters fulfilling certain needs in medical technology, and especially to fulfill the standard requirements for shock-protected connectors (DIN 42802 and IEC 601) in electrical medical devices.

According to the present invention, the foregoing objects are attained by a connection arrangement in which the cutting and clamping element is mounted in the interior of an insulating or insulated body having at least one access opening facilitating the insertion of the cable. An operating member made of insulating material is arranged to move on the insulating body such that movement of the operating member causes the cable or conductor inserted in the enlargement of the cutting and clamping contact element to be moved into the zone of the slot opening located between the cutting edges for formation of the contact.

Since the cutting and clamping contact element is located within an insulating body and a related operating member cooperating with the cable to be contacted is also of insulating material, the connection arrangement for all practical purposes forms a completely insulated unit. The electrical connection can occur between a medical-technical apparatus, for example a monitoring/evaluating apparatus addressing physiological data, and either a sample for testing or a patient to be tested, through the cutting and clamping contact element. Thus, no further contact element whatsoever is required on the sample or patent cable. Even the prescriptions corresponding to IEC-standards are fulfilled. According to those standards, with a separate connection arrangement, no conductive parts, which are in the position to touch or strike a flat conductive surface, may be connected with the patient.

Especially high contact security is attained as shown by the exemplary embodiments in which a second insulating body is mounted movably on the primary insulating body. The second insulating body can be moved out of its initial setting into a contact forming setting. In the initial setting, the second insulating body releases the access opening for the insulated or conductor cable to enter the enlarged portion of the slot opening. In the contact forming setting, the second insulating body closes off the access opening of the first insulating body as far as the passage area of the insulated cable or conductor.

Other objects, advantages and salient features of the present invention will become apparent from the following detailed description, which, taken in conjunction with the annexed drawings, disclose preferred embodiments of the present invention.

BRIEF DESCRIPTION OF THE DRAWINGS

Referring to the drawings which form a part of this disclosure:

FIG. 3 is a front elevational view of a multipolar/polyphase electrical connection arrangement according to a second embodiment of the present invention;

FIG. 4 is a side elevational view in section taken along line IV—IV of FIG. 3;

FIG. 5 is a top plan view of the electrical connection arrangement of FIG. 3; and FIG. 6 is a bottom plan view of the electrical connection arrangement of FIG. 3.

DETAILED DESCRIPTION OF THE PREFERRED EMBODIMENTS

Figure 1:
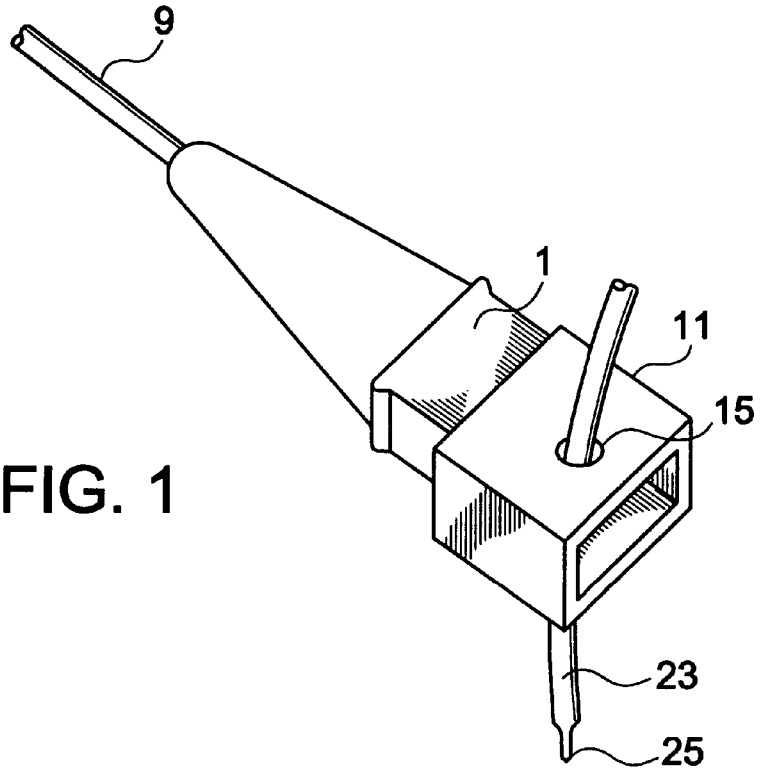
FIG. 1 is a perspective view of an unipolar electrical connection arrangement according to a first embodiment of the present invention.
Figure 2:
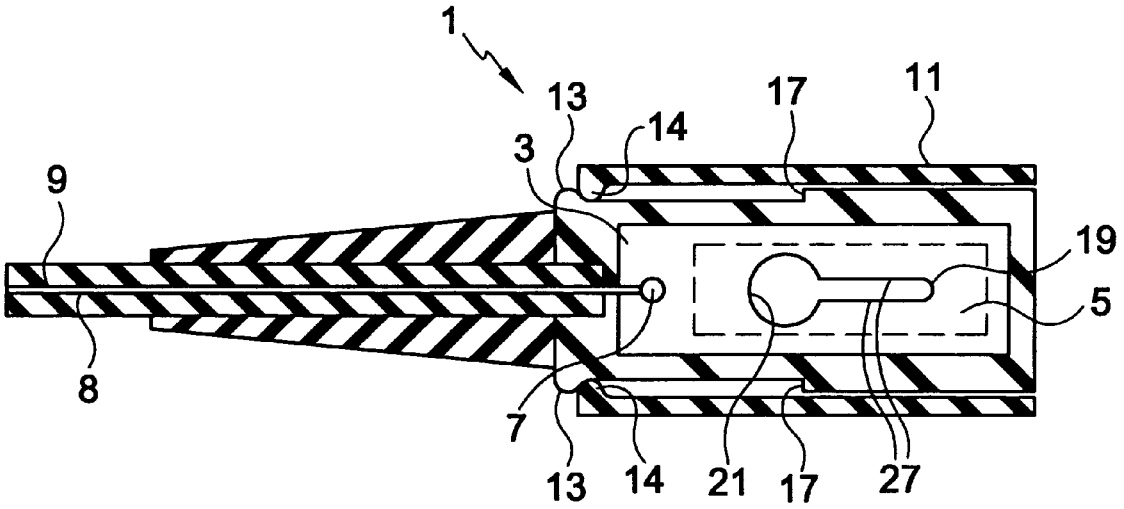
FIG. 2 is a top plan view in section of the unipolar electrical connection arrangement of FIG. 1.

The unipolar embodiment of the connection arrangement according to the present invention is shown in FIGS. 1 and 2. This arrangement has an insulating or insulated body 1 with its main part forming a large rectangular parallelepiped block. In the interior of the block, aligned in the center, a plate-like cutting and clamping contact element 3 is embedded in a known manner. Contact element 3 is injection molded in plastic material such that only an area 5 remains open to the exterior of the body 1. At a connection point 7, contact element 3 is connected with interior conductors 8 of an insulated cable 9. Cable 9 also has one end embedded in insulating body 1.

A sheathing 11, formed of insulating material, is mounted on the rectangular part of insulating body 1. The sheathing serves as the operating member for the connecting procedure, is adapted and fitted in form and dimensions to insulating body 1, and is mounted to slide thereon. In this manner, can be moved between the sheathing its two end settings shown in FIGS. 1 and 2, respectively. The end setting shown in FIG. 2 is defined by the engagement of detent ribs 13 and 14 on insulating body 1 and sheathing 11, respectively, and forms an initial setting for the connecting procedure. The other end setting, shown in FIG. 1, is defined by the engagement of detent shoulders 17 on insulating body 1 and sheathing detent ribs 14, and corresponds to the setting forming the contact.

Plate-like contact element 3 has a known type of slot opening 19. The longitudinal axis of the opening extends in the direction of the sliding movement of sheathing 11. On the interior end area adjacent to cable connection point 7, slot opening 19 opens into a circular enlargement 21. The circular enlargement forms the opening for introduction of an insulated cable or conductor 23 to be connected by the connection arrangement. The connection end of this cable 23 is completely insulated. For this purpose cable 23 is terminated with a cut-off forming a dull, truncated shape at the end. The insulating covering of the cable is pulled up and is welded at the end 25. Alternatively, the dull, truncated cut-off end of the cable could be insulated by being dipped in insulating resin and then allowed to harden.

Insulating body 1, covered by sheathing 11, has access openings in two opposite walls in area 5 for passage of the cable to be connected. These access openings are in alignment with slot opening 19 of contact element 3 and are adapted thereto in contour and dimensions.

Sheathing 11 has openings 15 aligned with one another on two facing walls. The opening diameters are adapted to those of the connecting insulated cable or conductor 23. In the case of the initial setting of sheathing 11 shown in FIG. 2, openings 15 are aligned with the enlargement 21 of slot opening 19 in contact element 3. The parallel edges of slot opening 19 joining with enlargement 21 form cutting edges 27, which penetrate the insulation of cable 23 in a known manner in the connecting procedure. With proactive movement of sheathing 11 from its initial setting (FIG. 2) into the contact formation setting shown in FIG. 1, cable 23, when inserted through openings 15 and through the access openings in insulating body 1, is moved out of the area of enlargement 21 of the slot opening into the zone located between cutting edges 27. With sheathing 11 in this contact forming setting, the access openings, which make interior contact element 3 in insulating body 1 accessible, are covered by insulating sheathing 11 as far as the area 5 of the access openings. Openings 15 are in turn closed off and insulated by the insulating covering of the cable 23 extending through openings 15. In the contact forming setting shown in FIG. 1, the connection arrangement for all practical purposes forms a completely insulated unit.

A second embodiment of the connection arrangement of the present invention is shown in FIGS. 3 to 6. This arrangement is a three-pole embodiment, and likewise has an insulating body 101. In the interior of body 101, three cutting and clamping contact elements 103 are embedded. Each contact element 103 has a slot opening 119, and is bent down in such a manner that its main part has slot opening 119 in the vicinity of one of the access openings 122 aligned therewith. The slot openings extend perpendicular to the inlet direction of cable 109. The cable interior conductors, of which only one conductor 108 is to be seen in FIG. 4, are connected with contact elements 103 at connecting points 107.

Insulating body 101 has an interior recess 129 connected to access openings 122, and is arranged so that an interior guide surface 131 is formed on the side of access openings 122. A second, sliding, insulating body 133 is slidably guided in interior recess 129. This staple-configured insulating body 133 has the shape of a U-profile, overlapping contact element 103 with its arms 135. The free ends of the arms form semi-circular recesses 137. In the initial settings shown in FIGS. 3 and 4, semi-circular recesses 137 free the openings 122 in insulating body 101 sufficiently that the insulated, connecting patient-cables or conductors 123 can be inserted through recesses 137 of insulating body 133 and into the enlargements 121 of slot openings 119 of contact elements 103. With proactive movement of staple-like insulating body 133 out of the initial setting shown in FIGS. 3 and 4 inwardly (downward in FIGS. 3 and 4), inserted insulated cables 123 are forced into the area of cutting edges 127 of slot openings 119.

Staple-like insulating body 133 has attachments on its sides in the form of flexible plastic tabs 139 having fastening hooks 141 at their ends. Fastening hooks 141 catch flexibly in detent notches 143 formed on insulating body 101. Staple-like insulating body 133 is therefore secured detachably by means of the detent notching. With movement of staple-like insulating body 133 into the setting forming the contact, plastic tabs 139 are deformed and spring back following formation of the contact, so that insulating body 133 returns to its initial setting. After returning to the initial setting, the arrangement in turn is ready for connection of the subsequent patient cable 123.

While various embodiments have been chosen to illustrate the invention, it will be understood by those skilled in the art that various changes and modifications can be made therein without departing from the scope of the invention as defined in the appended claims.

What is claimed is:

1. An electrical connection arrangement, comprising:

a cutting and clamping contact element having at lest one slot opening to receive a conductor of an insulated cable, said slot opening having opposed cutting edges and an enlargement to initially receive an end portion of an insulated conductor;

an insulated body formed by a rectangular parallelepiped block having an interior in which said contact element is embedded, having a longitudinal side and a longitudinal axis defining a longitudinal direction and having at least one access opening through which an insulated conductor can be inserted into said contact element, said contact element extending parallel to said longitudinal side of said block with said slot opening extending in said longitudinal direction in alignment with said longitudinal side; and an operating member of insulating material movably and slidably mounted on said insulated body between an initial setting permitting access to said enlargement by an insulated conductor and a contact forming setting in which said operating member closes said access opening at least as to permitting access to said enlargement, movement of said operating member on said insulated body causing an insulated conductor inserted in said enlargement of said contact element to move in said slot opening to and from between said cutting edges, said operating member having a sheathing on an exterior of said block and slidable in said longitudinal direction along said longitudinal side, said sheathing having aligned openings with closed peripheries in which an insulated conductor can be inserted, said aligned openings being aligned with said enlargement in said initial setting and being aligned with said cutting edges in said contact forming setting.

2. The electrical connection arrangement according to claim 1 wherein said contact element comprises a plate; and said cutting edges are formed by borders of said slot opening extending parallel to one another.

3. The electrical connection arrangement according to claim 1 wherein said slot opening has a closed shape in said contact element;

said enlargement is circular and located at one end of said slot opening.

4. The electrical connection arrangement according to claim 1 wherein a plurality of contact elements having a plurality of slot openings to connect a plurality of insulated conductors are mounted in said insulated body; and said insulated body comprises a corresponding plurality of access openings.

5. The electrical connection arrangement according to claim 4 wherein said operating member is operatively associated with all of said slot openings.

6. An electrical connection arrangement, comprising:

a cutting and clamping contact element having at least one slot opening to receive a conductor of an insulated cable, said slot opening having opposed cutting edges and an enlargement to initially receive an end portion of an insulated conductor;

an insulated body having an interior in which said contact element is mounted, having at least one access opening through which an insulated conductor can be inserted into said contact element and having an interior guide extending along said slot opening of said contact element;

an operating member of insulating material movably mounted in said insulated body, movement of said operating member in said insulated body causing an insulated conductor inserted in said enlargement of said contact element to move in said slot opening to between said cutting edges, said operating member being slidably mounted in said interior guide between an initial setting permitting access to said enlargement by an insulated conductor and a contact forming setting in which said operating member closes said access opening at least as to permitting access to said enlargement;

flexible elastic tabs on sides of said operating member, each said tab having hook on one end thereof; and catch notches on said insulated body in which said hooks are engaged;

whereby said operating member can be moved relative to said insulated body into said contact forming setting with elastic deformation of said tabs to bias said operating member toward said initial setting.

* * * * *